US007219810B2

(12) United States Patent
Willim

(10) Patent No.: US 7,219,810 B2
(45) Date of Patent: May 22, 2007

(54) MOBILE CRANE WITH ELONGATED BOOM

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 256 days.

(21) Appl. No.: 10/730,402

(22) Filed: Dec. 8, 2003

(65) Prior Publication Data

US 2004/0124167 A1 Jul. 1, 2004

(30) Foreign Application Priority Data

Dec. 6, 2002 (DE) ..... 202 18 971 U

(51) Int. Cl.
*B66B 23/42* (2006.01)

(52) U.S. Cl. ..... 212/300; 212/239; 212/262

(58) Field of Classification Search ..... 212/300, 212/239, 262
See application file for complete search history.

(56) References Cited

U.S. PATENT DOCUMENTS

| | | | | |
|---|---|---|---|---|
| 3,028,018 | A * | 4/1962 | Mott | 212/300 |
| 3,173,549 | A * | 3/1965 | Bender | 212/300 |
| 3,209,920 | A | 10/1965 | De Cuir | |
| 3,426,915 | A * | 2/1969 | Tesch | 212/300 |
| 3,804,264 | A * | 4/1974 | Hedeen et al. | 212/295 |
| 3,815,759 | A | 6/1974 | Gallay | |
| 4,068,762 | A * | 1/1978 | Kennard et al. | 212/300 |
| 4,194,638 | A * | 3/1980 | Morrow et al. | 212/239 |
| 4,383,616 | A * | 5/1983 | Sterner et al. | 212/299 |
| 4,394,914 | A * | 7/1983 | Privat | 212/203 |
| 5,292,016 | A * | 3/1994 | Casavant et al. | 212/177 |
| 6,655,539 | B2 * | 12/2003 | Bertinotti | 212/300 |

FOREIGN PATENT DOCUMENTS

| | | |
|---|---|---|
| DE | 339 191 | 7/1921 |
| DE | 100 22 600 | 7/2001 |
| DE | 201 07 984 | 12/2001 |
| DE | 101 07 389 | 8/2002 |
| EP | 097 0 914 | 1/2000 |
| EP | 106 5166 | 1/2001 |
| GB | 981 129 | 1/1965 |
| JP | P2002-60183 A * | 2/2002 |

* cited by examiner

*Primary Examiner*—Thomas J. Brahan
(74) *Attorney, Agent, or Firm*—Dilworth & Barrese LLP

(57) ABSTRACT

The invention concerns a mobile crane with a long main boom. According to the invention, the main boom is in two parts linked at a swivel point in such manner that the boom can bend when raised and can be positioned in extended or quasi-extended final erection position.

11 Claims, 5 Drawing Sheets

MOBILE CRANE WITH ELONGATED BOOM

BACKGROUND OF THE INVENTION

The invention concerns a mobile crane with an elongated boom.

Longer and longer booms are being required in special applications. The problem of raising very long booms arises particularly in connection with the erecting of wind generators. Booms of this type are usually raised with an extension derrick boom with attached derrick ballast. However, this is very time-consuming, and in the difficult terrain in which wind generators are often located it is very difficult to do.

Theoretically it is already known how to equip main booms with rocking grid tips. In rocking tips of this type, retainer devices must be provided. Furthermore, after the main boom is raised, they are usually in a bent position in relation to the main boom.

SUMMARY OF THE INVENTION

It is the task of the within invention now to permit the erecting of very long main booms without a derrick boom, whereby the entire erection procedure is made easier and in particular long main booms can be raised.

According to the invention, this task is performed by the following characteristics: the main boom is in two parts connected with each other at a swivel point in such manner that the main boom can be bent during erection in order to be moved into an extended or quasi-extended final erection position. This raised main boom does not require any retainer device.

Preferably there is on the main boom a special adaptor with at least one strut member that is positioned to swivel on a swivel point. This adaptor can be positioned at any desired location on the boom.

An outward-swiveling support can be jointed on the strut member.

The mobile crane can have an auxiliary coil off and on which an auxiliary guy can be wound.

Additionally, there can be an adjustment coil over which an adjustment strap can be drawn to the tip of the strut member, which it can be attached by means of a hook.

The adjustment strap can be drawn over this adjustment coil to raise the bent front section of the main boom.

Preferably, two strut members can be positioned parallel to each other.

The swivel axles of the two strut members can be positioned on an oblique in relation to the main boom, in which case by means of the oblique arrangement of the swivel axles of the two strut members a lateral guying can be achieved that further increases the lateral stability of the boom.

BRIEF DESCRIPTION OF THE DRAWINGS

Additional details and advantages of the invention are explained in greater detail by means of the embodiment illustrated in the drawing, which shows.

DESCRIPTION OF THE PREFERRED EMBODIMENTS

Figure 1:
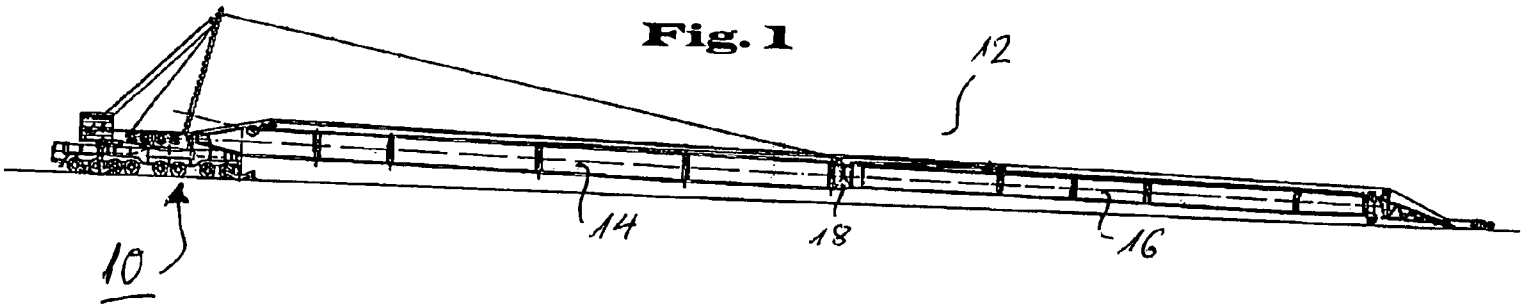
FIG. 1: A side view of a mobile crane according to the within invention, with a main boom still lying on the ground.

FIG. 1 shows a mobile crane 10 with a main boom 12 consisting of a lower boom segment 14 and an upper boom segment 16, which are connected so as to swivel on a coupling point 18. In FIG. 1 the entire boom length of the main boom 12 is assembled on the ground. This main boom has a special adaptor that is equipped with a knee joint and a strut member and which is installed in the place of a standard adaptor. This adaptor can be installed at any desired point on the boom.

Figure 5:
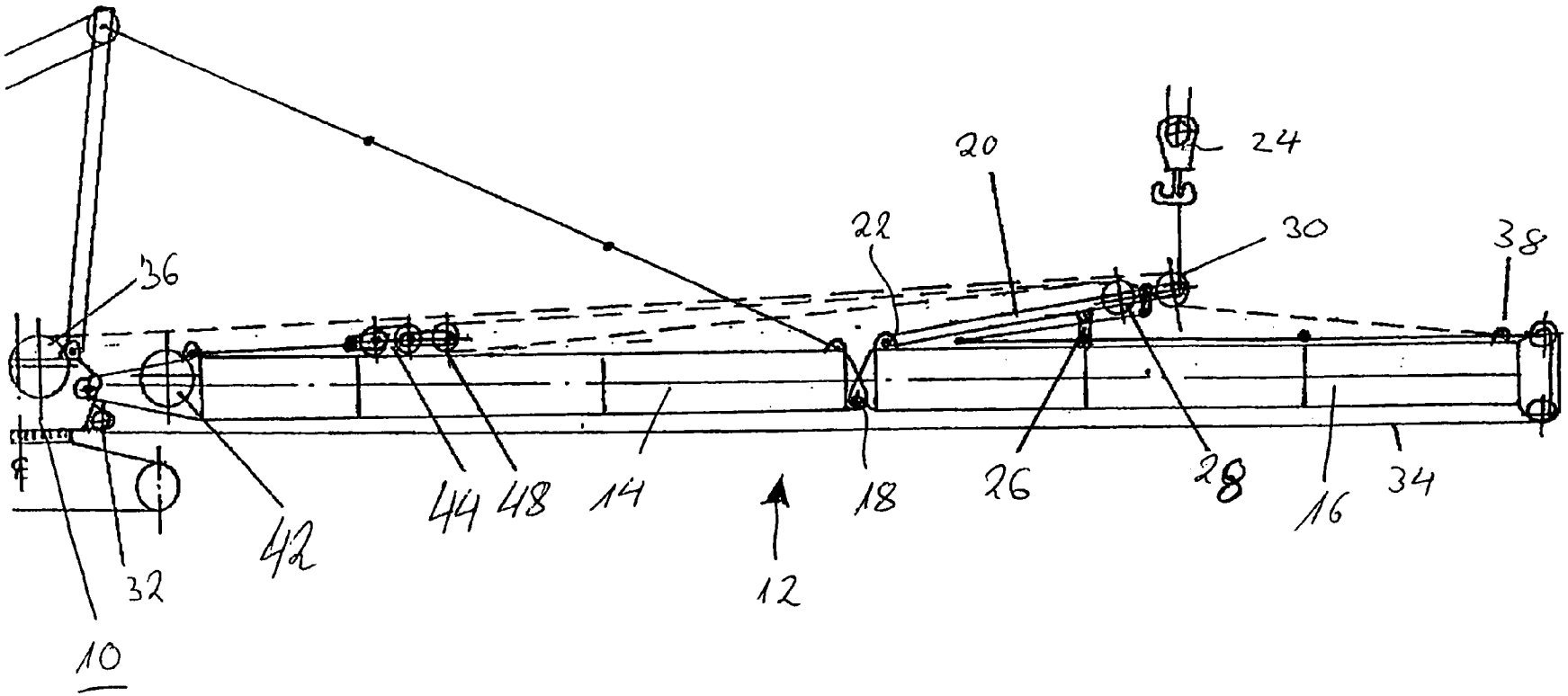
Figure 6:
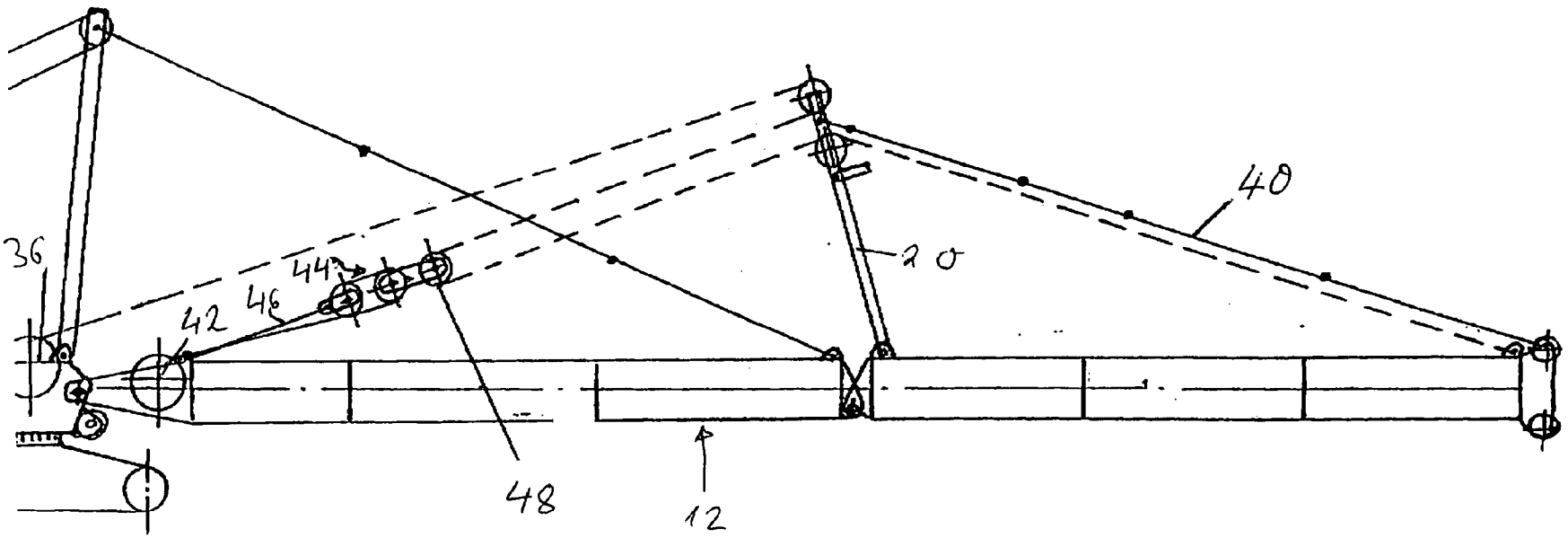
Figure 7:
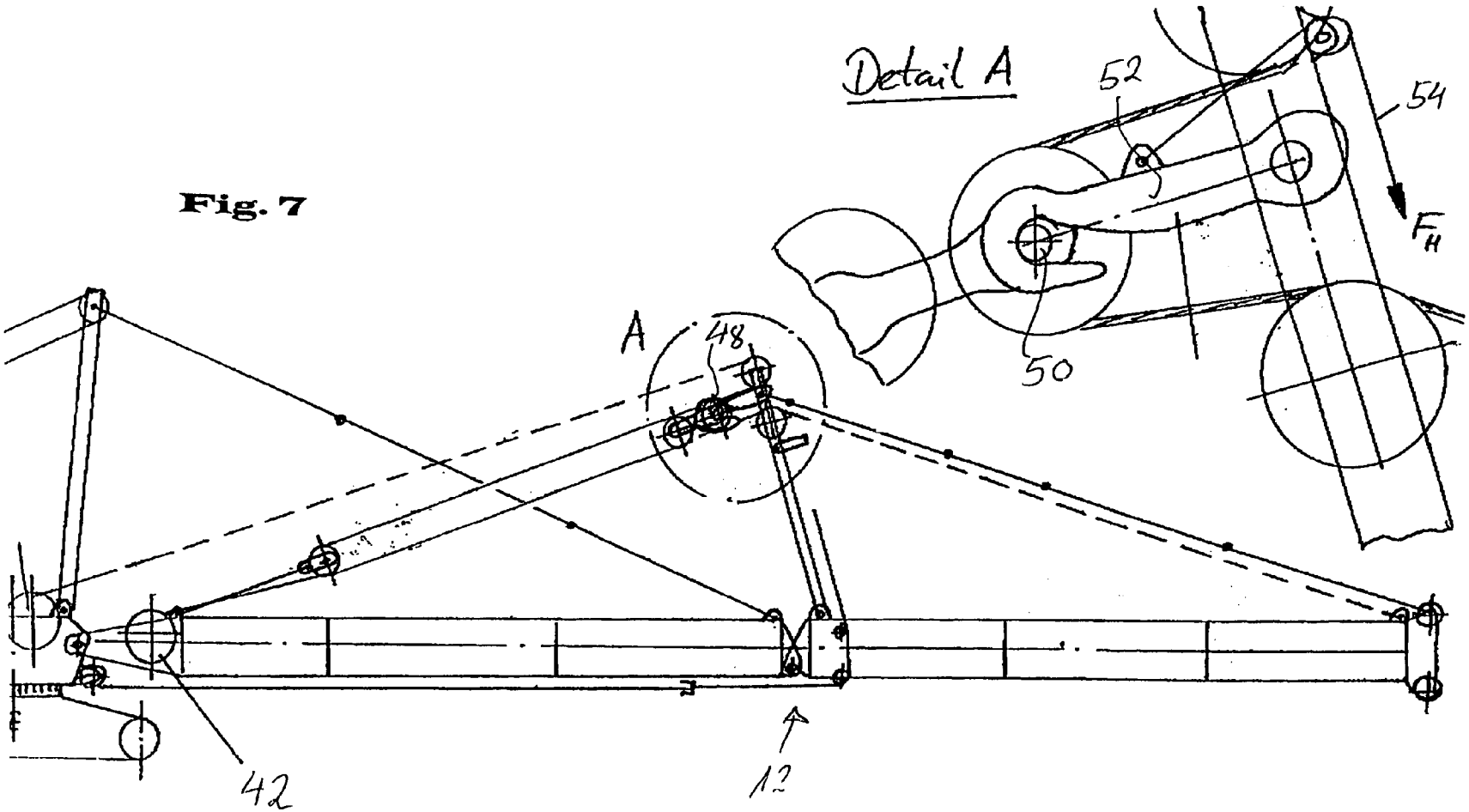

The assembly of the crane and the mobile crane 10 components necessary for the raising of main boom 12 are explained in greater detail by means of FIGS. 5 to 7.

FIG. 5 shows that there is a strut member on the upper segment of main boom 16, which said strut member 20 can pivot on a coupling joint 22 toward upper boom 16. When the main boom is raised, auxiliary crane 24 raises strut member 20 slightly out of transportation position, until a lever arm is created with respect to coupling joint 22. By means of a fold-out support 26 the strut member 20 is held in this position. Two rollers 28 and 30 are positioned at the tip of strut member 20.

There is on mobile crane 10 an auxiliary coil 32 over which an auxiliary guy 34 is drawn and led backward, as partially indicated by the dotted lines in FIG. 5, to a hoist 36. Here auxiliary guy 34 is connected with a hoisting cable wound on the hoist. With auxiliary coil 32, by means of auxiliary guy 34, the hoist is pulled forward to attachment point 38 near the tip of upper segment 16 of main boom 12. There the hoist is bolted to fixed point 38.

FIG. 6 shows the raising of strut member 20. Through the winding of the hoisting cable on hoist 36, the strut member 20 is straightened independently and guys front anchoring rod 40. An adjustment coil 42, with which an adjustment strap 44 is coupled, is positioned on main boom 12. Through the winding of an adjustment cable 46 off adjustment coil 42, and the simultaneous winding up of hoist 36, the upper adjustment pulley 48 is drawn to the tip of the strut member until a pin 50 at the upper adjustment pulley 48 engages in a hook 52 (compare FIG. 7 and particularly Detail A on FIG. 7).

For disassembly, hook 52 can be raised with a short auxiliary guy 54 (compare Detail A in FIG. 7). The short auxiliary guy 54 is additionally connected with the long auxiliary guy 34, so that the necessary force can be brought to bear on auxiliary coil 32.

Figure 2:
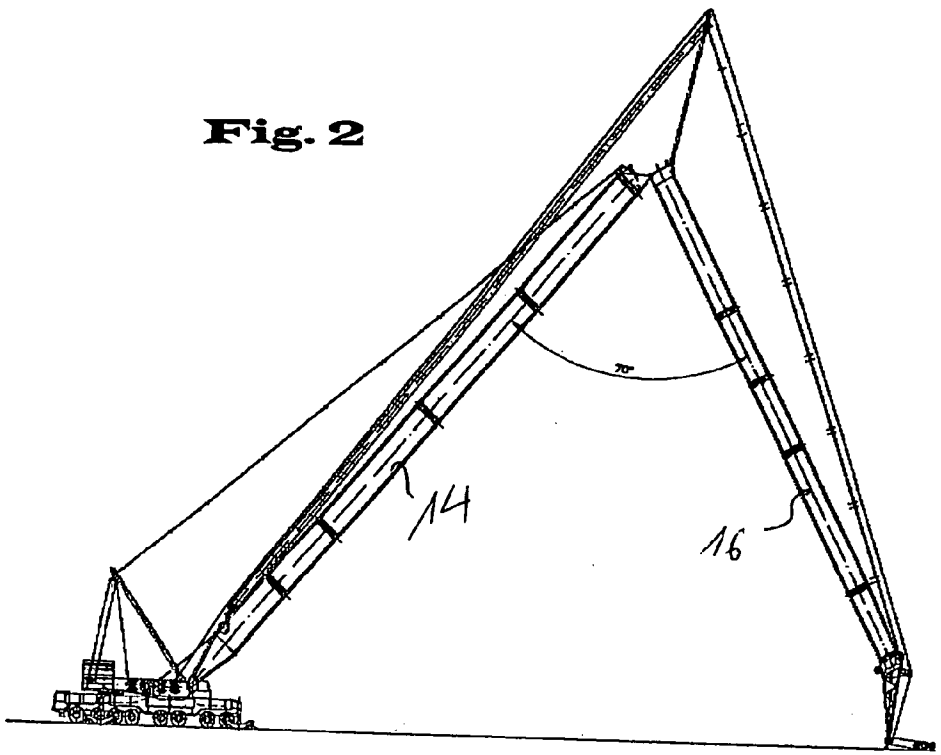
FIGS. 2 to 4: Various working sections during the raising of the main boom in an embodiment as illustrated in FIG. 1, FIGS. 5 to 7: Details during the erection of the mobile crane.
Figure 3:
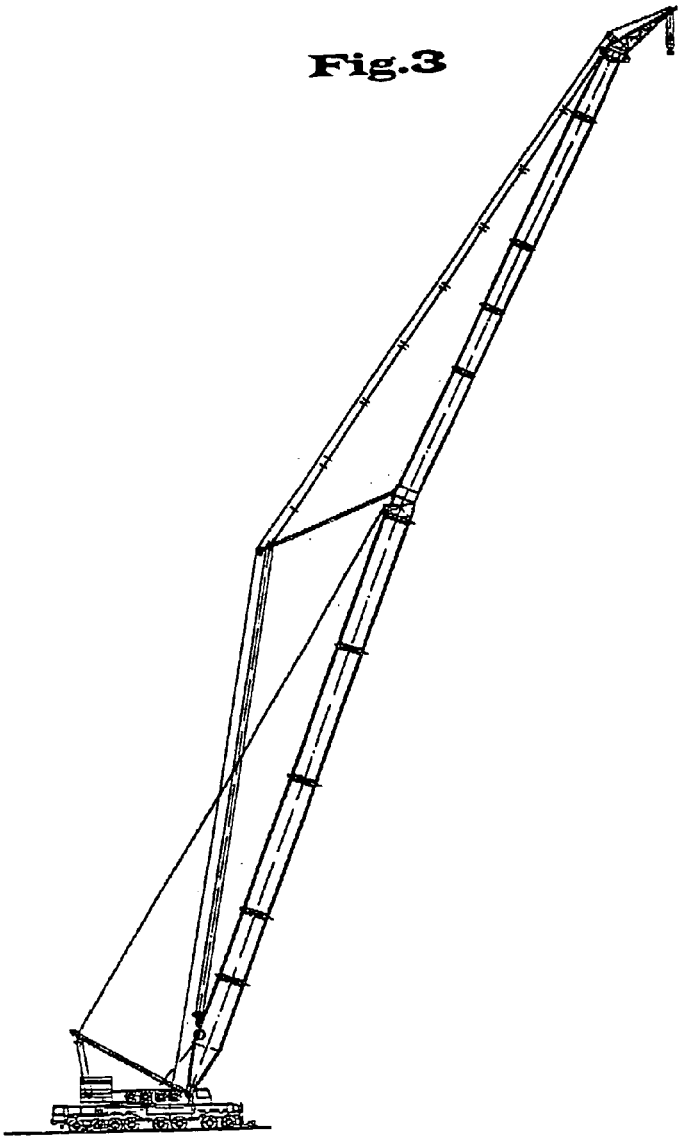
Figure 4:
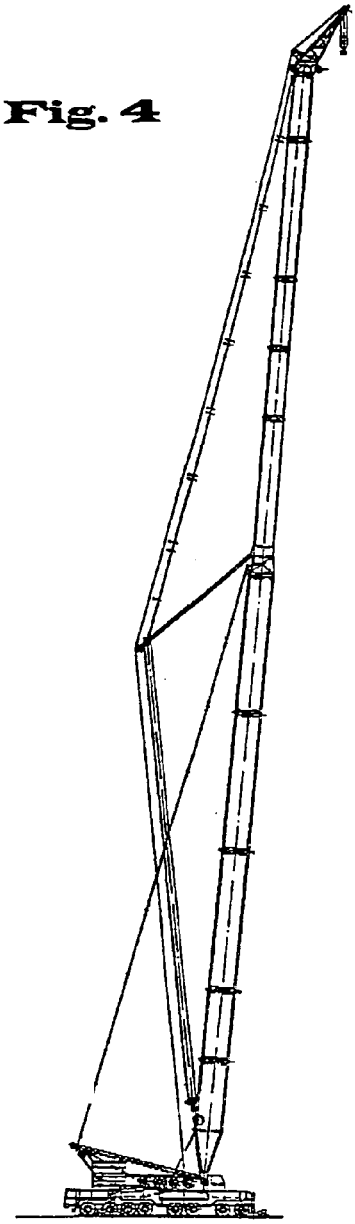

When the main boom is raised, as shown in FIGS. 2 to 4, the lower segment 14 of the main boom is raised first (compare FIG. 2). The tip of the upper segment of boom 16 thereupon rolls on the ground, or is held in suspension with an auxiliary crane. During the raising of lower segment 14 of main boom 12, adjustment strap 44 is continually slackened, so that the boom head weight lies on the ground and therefore does not have to be raised with lower segment 14. After the lower segment of the main boom has reached an appropriate angle to the ground, with consequent displacement of the loads closer to the crane, upper segment 16 of the main boom is pulled up by the pulling of the adjustment strap 44 by means of adjustment coil 42. The main boom is still inclined forward, so that the boom can be moved into an extended position without any need for a retainer device. The boom is drawn up to a stop device and adjustment strap 44 is secured. The stability of boom 10 is further increased by means of this additional guying.

The invention claimed is:

1. Mobile crane (10), comprising a long main boom (12) comprising two boom parts (14, 16) pivotally linked together, a swivel point (18) at which said two boom parts (14, 16) are pivotally linked, said two boom parts (14, 16) being structured and arranged with respect to one another such that when said main boom (12) is initially raised from a flat, extended position along the ground, the boom parts (14, 16) bend with respect to one another, as said main boom (12) is raised, an upper one (16) of the boom parts (14, 16) swivels with respect to a lower one (14) of the boom parts (14, 16) to position the main boom (12) in extended or partially-extended final erection position with the boom parts (14, 16) extended either substantially colinear or at a swivel angle with respect to one another, at least one strut member (20) positioned to swivel on an additional swivel joint (22) positioned upon one (16) of said boom parts (14, 16), an adjustment coil (42) positioned upon the main boom (12) and an adjustment pulley (48) arranged to be drawn to a tip of the strut member (20) by turning said adjustment coil (42), a pin (50) situated upon said pully (48), a hook (52) pivotally mounted upon said strut member (20), and said additional swivel joint (22) positioned upon the upper boom part (16), with said pin (50) and hook (52) structured and arranged to engage one another upon raising said strut member (20) with respect to said respective boom part (16).

2. Mobile crane (10) according to claim 1, additionally comprising a fold-out support (26) coupled to the strut member (20) at a point remote from said additional swivel joint (22) and supporting said strut member (20) upon said respective boom part (16) at an oblique angle as said main boom (12) is being raised.

3. Mobile crane (10) according to claim 1, additionally comprising a coil (32) and a guy (34) arranged to be wound on or unwound off said coil (32).

4. Mobile crane (10) according to claim 3, additionally comprising a hoist (36) having a hoisting cable connected to said guy (34), and a point (38) near a tip of one (16) of said boom parts (14, 16) and to which said guy (34) is attached.

5. Mobile crane (10) according to claim 4, wherein said attachment point (38) is positioned near the tip of the upper boom part (16).

6. Mobile crane (10) according to claim 1, additionally comprising an adjustment strap (44) wrapping around said adjustment pulley (44), a second pulley about which said adjustment strap (44) also wraps, and a cable (46) interconnecting said adjustment coil (42) and strap (44) at a lower portion of said strap (44) by also wrapping around said second pulley.

7. Mobile crane (10) according to claim 6, additionally comprising two rollers (28, 30) positioned at a tip of said strut member (20) remote from said additional swivel joint (22), another coil (32) positioned upon said mobile crane (10), a guy (34) wound about said another coil (32), a hoist (36) having a hoisting cable connected to said guy (34), a point (38) near a tip of the upper boom part (16) and to which said guy (34) is attached, and said guy (34) being wound about said two rollers (28, 30).

8. Mobile crane (10) according to claim 7, additionally comprising a further guy (54) coupled to said guy (34) and hook (52) to disengage said hook (52) from said pin (50) upon disassembly.

9. Mobile crane (10) according to claim 1, structured and arranged such that upon raising said main boom (12) from the flat, extended position along the ground, the lower boom part (14) is raised, said strut member (20) is independently raised with respect to said main boom (12), and then the upper boom part (16) is pivoted and raised with respect to said lower boom part (14).

10. Mobile crane (10) according to claim 9, additionally comprising an anchoring rod (40) coupled to a point of said strut member (20) remote from said additional swivel joint (22) and an end of said respective boom part (16) remote from said additional swivel joint (22), such that raising said strut member (20) with respect to said main boom (12) tightens and guys said anchoring rod (40).

11. Mobile crane (10) according to claim 1, wherein said strut member (20) extends away from said respective boom part (16) in raised position of said main boom (12).

* * * * *